United States Patent [19]

Maze

[11] 4,189,989

[45] Feb. 26, 1980

[54] GABLE VENTILATORS

[76] Inventor: Perry V. Maze, 701 Morton, Falls City, Nebr. 68355

[21] Appl. No.: 879,762

[22] Filed: Feb. 21, 1978

[51] Int. Cl.[2] ..... F24F 7/02

[52] U.S. Cl. ..... 98/42 R; 98/43 R; 98/66 R

[58] Field of Search ..... 98/42 R, 43 R, 43 C, 98/58-60, 66 R; 52/198, 199, 200

[56] References Cited

U.S. PATENT DOCUMENTS

| | | | |
|---|---|---|---|
| 679,912 | 8/1901 | Preuthun | 98/43 R |
| 832,242 | 10/1906 | Davis | 98/66 R |
| 893,978 | 7/1908 | Braycker | 98/66 R |
| 2,909,113 | 10/1959 | Hatcher | 98/60 |
| 3,149,553 | 9/1964 | Solzman | 98/43 R |
| 3,314,355 | 4/1967 | Bassett | 98/66 R |
| 3,520,245 | 7/1970 | Painter | 98/43 R |

*Primary Examiner*—Henry C. Yuen
*Attorney, Agent, or Firm*—Thomas M. Scofield

[57] ABSTRACT

Improvements in roof ventilators; improvements in gable type roofing ventilators of the type typically having a vertical stack or chimney with a screening canopy thereover; provision of a dead air space at the top of a stack or chimney underneath and within an overlying hoodlike canopy; provision of a reversing flow channel by association of two hoodlike canopies with a stack, one of the canopies also providing an air capture space or trap at the top of the stack.

15 Claims, 10 Drawing Figures

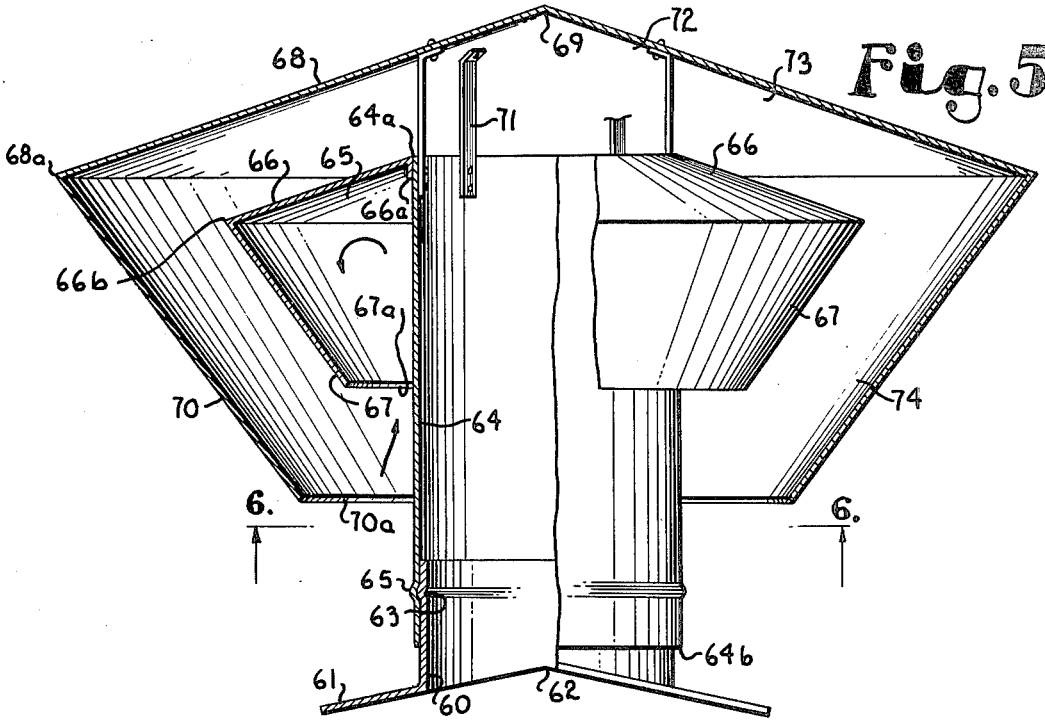
Fig. 5.
Fig. 6.
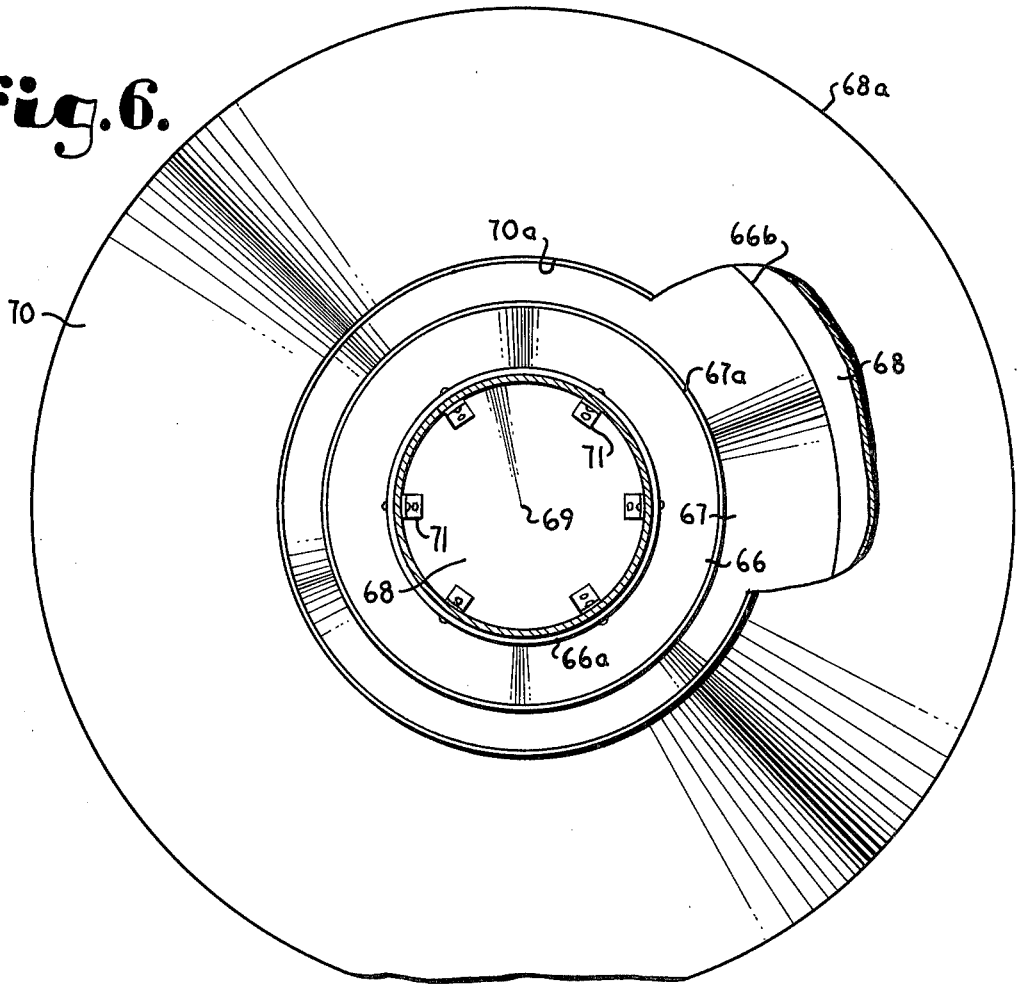

GABLE VENTILATORS

BACKGROUND OF THE INVENTION

Ventilator stacks or chimneys with canopies thereover are well known to the art, as may be seen from the below listed patents. The stack communicates with the air space underneath a roof and permits excessively heated and/or stale or polluted air to escape to the outside. The canopy is for the purpose of preventing rain and snow from falling back down the stack. Closures are often provided in order that the ventilating function may be lessened or stopped or, conversely, any backlash of the elements by way of wind or the like minimized. Typically, the canopy or hood will extend below the upper discharge edge of the stack or chimney for maximum protection.

However, in all of the previous designs, despite the presence of the canopy, or its configuration, or associated apparatus with the stack and canopy, effective weather proofing has not been achievable. It is most desired to keep the ventilating function constant, while deflecting or preventing flow back or blow under with respect to the canopy, rather than providing actual closure means. The latter malfunction eventually or break.

In gable mounted stacks with canopies, the impact of the atmospheric air, winds and air currents against the roof typically blows air up under the canopy. This may carry snow, hail, rain or the like, causing objectionable effects within the building. What is desired is a stack-canopy-other construction which will continuously maintain the ventilating function, while minimizing or preventing the many and varied negative effects of weather, particularly including snow, high wind, rain, hail and the like. To date this had not been achieved by others.

BRIEF DESCRIPTION OF THE INVENTION

The subject invention has three basic parts. First is the conventional stack or chimney. This may be circular, oval, square or rectangular in transverse (usually horizontal) section. Fixed to the upper, outboard surface of the stack or chimney is a circumferential first hoodlike canopy which may be an arcuate construction, but typically is a first outwardly and downwardly extending flange, on the outer end of which is a second circumferential downwardly and inwardly extending flange. This first hoodlike canopy provides, at or closely adjacent the stack or chimney and outside thereof, a dead air space or air-water-snow-hail capture space or zone. The third portion of the subject construction, compress a second hoodlike canopy which overlies and is spaced upwardly from both the upper discharge end of the stack or chimney and the first hoodlike canopy or dead air space or air capture zone defining structure. The outer periphery of this member is a downwardly and inwardly extending wall which extends well below the lower edge of the first hoodlike canopy.

Thus, a continuous passage is provided immediately outboard of the top of the stack or chimney which leads outwardly, downwardly and inwardly, discharging below the lower edge of the second hoodlike canopy. Suitable structurals are provided between the stack and second hoodlike canopy to support same. Additional structurals may be provided between the first hoodlike canopy and second hoodlike canopy. Further structurals may be provided between the second hoodlike canopy and the roof construction or roof jack, if desired. The latter is the means for connecting between the roof proper and the stack.

In all cases, the air flow passage above and outboard of the upper end of the stack or chimney has a cross sectional area equal to or greater than (preferably the latter) the cross sectional area of the chimney or stack itself. Bird and/or insect screens may be provided between the outside surface of the stack or chimney and the lower end of the second hoodlike canopy for protective purposes.

The combination of the provision of the dead air space or trap at the top of the stack peripheral thereto and the reversing flow passage for stack gas discharge outside thereof, together with the extension of the outer hoodlike canopy below the trap, operate to provide a new protected ventilator construction of great versatility.

THE PRIOR ART

Applicant is aware of the following patents directed to roof ventilators, relief vents, sky light ventilators and the like.

Mark, U.S. Pat. No. 230,952 "Ventilator" issued Aug. 10, 1880;

Harpham, et al., U.S. Pat. No. 677,512 "Combined Sky Light . . . " issued July 2, 1901;

Preuthun, U.S. Pat. No. 679,912 "Ventilating Sky Light," issued Aug. 6, 1901;

Rose, U.S. Pat. No. 941,171 "Ventilator," issued Nov. 23, 1909;

Seymour, U.S. Pat. No. Sept. "Roofing And Ventilated Roof Structure," issued Sep. 10, 1940;

Painter, U.S. Pat. No. 3,520,245 " . . . Intake Air Vent . . . ," issued July 14, 1970; and Constantinescu et al., U.S. Pat. No. 3,793,930, issued Feb. 26, 1974 ". . . Deflector . . . "

OBJECTS OF THE INVENTION

A first object of the invention is to provide improved roof ventilators particularly adapted for gable (roof summit) application and installation.

Another object of the invention is to provide new and improved roof ventilators of several types and constructions, of the most variable and versatile use, wherein any hot air under pressure in the roof space may escape, but little or no cold air, rain, snow, dust or the like can get back into the roof space through the chimney or stack by reverse action.

Another object of the invention is to provide a three part improved ventilator construction made up basically of a chimney or stack, a dead air space defining construction and a canopy-wall superstructure which accomplishes the ventilation purposes desired for the space with which the stack communicates, but effectively prevents reverse gas flow under substantially any possible air conditions or environmental conditions.

Another object of the invention is to provide improved roof ventilator designs so constructed that the entire top of the stack and the periphery thereof is hooded, whereby the attic or building pressure with which the stack communicates forces the ventilation, there also being provided unique and novel structural capture means associated with the stack or chimney within the hood or canopy which traps outside air, wind, rain, snow or other elements in a dead air space in such manner as to cause a fall back effect which prevents back pressure against the vented fumes or air.

Another object of the invention is to provide improved ventilators and ventilator constructions as described, the construction simple, strong, and having a long useful life despite continuous exposure to the elements, which ventilators are also relatively cheap to manufacture for the results obtained.

Another object of the invention is to provide such ventilator improvements which readily lend themselves to bird as well as insect proofing in such a way that the proofing is always readily available for inspection, replacement or repair.

Another object of the invention is to provide such improved ventilator construction wherein, if an extremely strong wind should force itself up under the canopy past the trap zone, the structure of the ventilator would cause the passage of such air over the top of the stack and down and out the other side of the ventilator, thus increasing the draw at the flue or chimney area, rather than causing a downdraft that might cause internal damage to the building or flash back or pilot blowout.

Another object of the invention is to provide such ventilator improvements which can be readily associated with forcing fans if such are desired or needed.

Other and further objects of the invention will appear in the course of the following description thereof.

THE DRAWINGS

In the drawings, which form a part of the instant specification and are to be read in conjunction therewith, embodiments of the invention are shown and, the various views like numerals are employed to indicate like parts.

FIG. 3 is a side, partly sectional view of the second form or variation of the subject ventilator with parts cut away to better illustrate the internal construction thereof.

FIG. 4 is a view taken along the line 4—4 of FIG. 3 in the direction of the arrows. Part of the ventilator is cut away to better illustrate the internal construction.

FIG. 5 is a side, partly sectional view of a third modification or form of the subject improved ventilator.

FIG. 6 is a view taken along the line 6—6 of FIG. 5 in the direction of the arrows with a portion of the ventilator cut away for illustrative purposes.

FIG. 7 is a side, partly sectional view of the fourth version or variation of the subject ventilator.

FIG. 8 is a plan view from above of the ventilator construction of FIG. 7 with parts of the ventilator cut away to better illustrate the internal construction thereof.

FIGS. 1 AND 2

Figure 1:
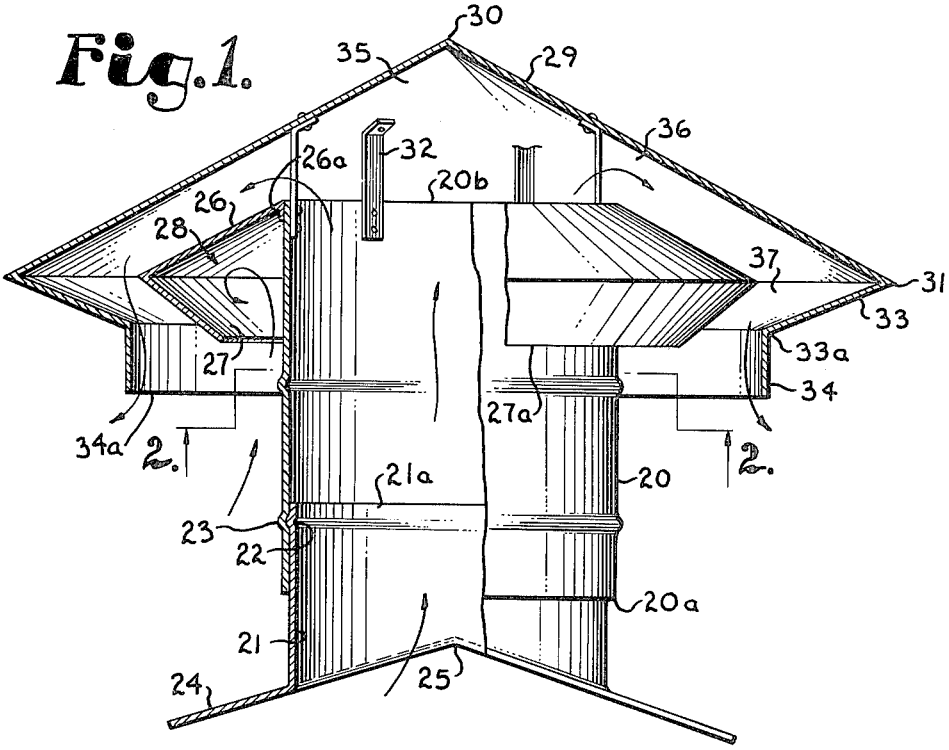
FIG. 1 is a side, partly sectional view of a first form of the subject ventilator with parts of the ventilator structure cut away to better illustrate its configuration.
Figure 2:
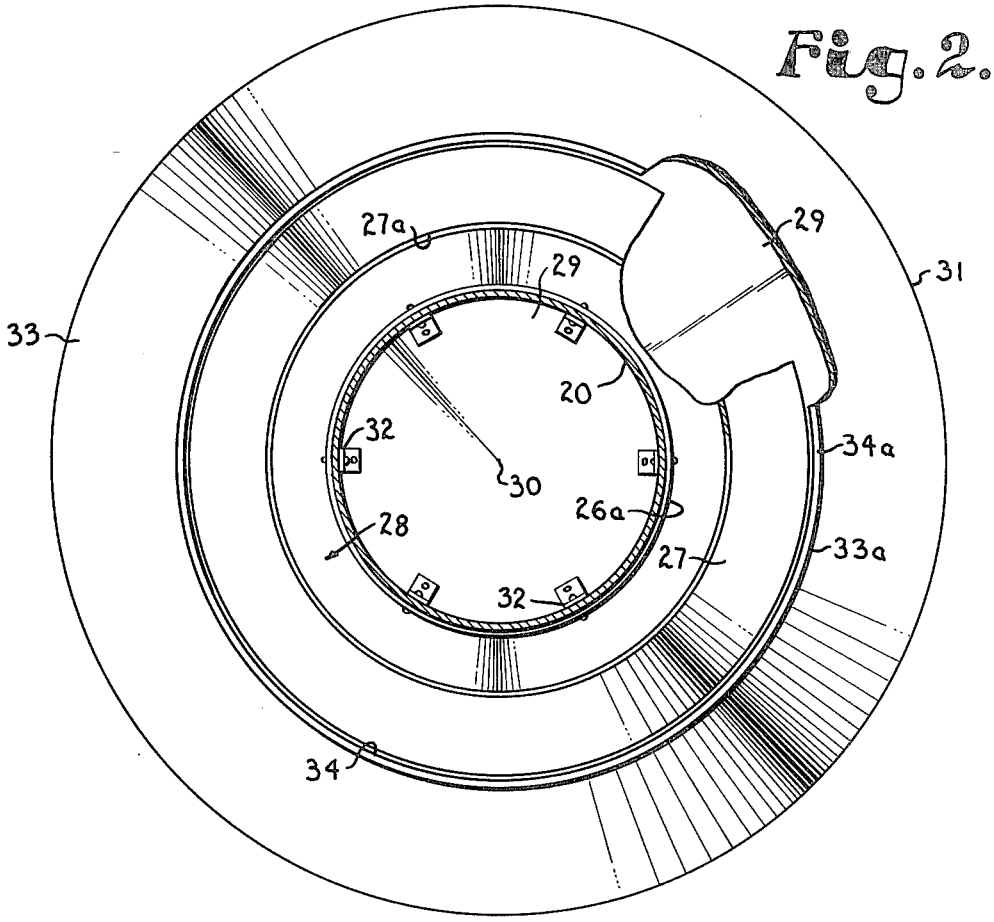
FIG. 2 is a view taken along the line 2—2 of FIG. 1 in the direction of the arrows. Parts of the structure are cut away for illustrative purposes.

FIGS. 1 and 2 show a first form of the improved ventilator construction. Therein is shown a preferably cylindrical, circular transverse cross section stack or chimney 20 having a lower end 20*a and an upper end* 20*b*. The lower end 20*a* is engaged by the cylindrical stub stack 21 which has a circumferential ridge 22 adjacent the upper end 21*a* of the stub stack, the said ridge 22 snapping into and engaging a like ridge-groove 23 in the main chimney or stack 20 adjacent its lower end 20*a*. Additional conventional metal fasteners of conventional sort may be employed to rigidly and securely connect stack 20 to the stub stack (not shown). The roof jack has a surrounding circumferential sheet 24 which angles upwardly to a central apex 25, thereby to provide a ridge connection adapter to fix the roof jack over a ridge or gable opening on a roof to receive gas or fumes therefrom. Conventional connectors, such as nails or screws fix the sheet 24 circumferentially to the roof surface under covering which may be added thereover. The conventional roof structure at the ridge for housing or commercial buildings is not shown.

What has been described is essentially a conventional cylindrical, circular section stack and roof jack adapter therefor. Fixed to stack 20 are the improved canopy-wall construction and dead air space zone defining structure as will be described. These comprise two hoodlike canopies with depending, inwardly extending walls, one on the stack itself the other above and supported by it.

A first hollow centered circular ring flange 26 is rigidly connected adjacent or at the upper end 20*b* of stack 20 on the outside face thereof by welding, brazing or rivets fixing lip or wall 26*a* to the outer surface of the upper end 20*b* of stack 20. Flange 26 angles downwardly circumferentially of its inboard connection to stack 20 and has, at its outboard end and circumferentially fixed thereto, continuous, circumferential second flange 27. Flange 27 inclines downwardly, but inwardly from its upper outboard connection with the outboard edge of flange 26. Between them, flanges 26 and 27 define a capture zone or dead air space 28 for purposes to be described.

A conical sheet of metal 29, having an upper apex 30 and an outboard end 31 is rigidly attached to the upper end of stack 20 adjacent end 20*b* by structural beams or supports 32 which are provided spaced around the inside periphery of the upper end of stack 20. Additional structural supports (depending upon the size of the overall ventilator, particularly) may be provided between the underside of canopy or sheet 29 and flange 26 or flange 27 (or both of them) in the manner analogous to the outboard structurals seen in FIGS. 9 and 10 supporting the canopy, to be described. Generally speaking, such will not be required.

At the periphery of sheet or canopy 29 there is continuously and circumferentially fixed downwardly, but inwardly extending wall portion 33. In the particular configuration shown, the canopy 29 preferably ends substantially in line with the end of flange 26 and wall portion 33 angles inwardly somewhat more sharply than flange 27, whereby wall portion 33 at its lower end portion 33*a* has a relatively close approach to the outboard surface of flange 27. Fixed to the inboard end 33*a* of wall portion 33 is lowermost wall length 34 which is preferably substantially vertically oriented and extends a distance below the lower edge 27*a* of flange 27. Wall portion 34 has lower edge 34*a* thereon.

From the structure just described, it may be seen that gases passing up the center of stub stack 21 and stack 20 exit under the apex of canopy 29 in a relatively restricted plenumlike zone 35. Under the impetus of the pressure within the building, the heat of the gases, or both, or a fan if such is employed with this ventilator (not shown), the fumes or gases to be ventilated pass into a first flow passage portion 36 between the underside of sheet 29 and the upper side of flange 26. Thereafter, the fumes pass into flow passage portion 37 between the inside faces of wall portions 33 and 34 of the outer canopy and the outside face of flange 27. This includes the relatively restricted zone between the outside face of flange 27 and lower end 33*a* of wall portion 33.

The cross sectional area of the flow passage in its entire length 36 and 37 should always be at least equal to and preferably at least somewhat greater in area than the total cross sectional area of stack 20 at its discharge. Even at the most restricted point in zone 37, opposite line 33*a*, this is the fact.

The first device of FIGS. 1 and 2 may advantageously be used as a flue cap or hot stack cap where there is a relatively higher pressure on the effluent from its heated nature and character. This modification has the greatest flow restriction both with respect to flow area provided and the sharpness of the bends provided of the various forms illustrated. The use of a rounded stack permits the least blow up along the side of the stack by winds impacting on it. The roundness of the outboard hoodlike canopy comprising sheet 29 and walls 33 and 34 also minimizes air catching and resistance as high velocity winds blow past. The configuration provided is so constructed as to minimize the possibility of downdraft back through stack 20 which might blow out a pilot or burner, thus causing fumes or explosions. Any wind which blows upwardly under the outboard hoodlike canopy, particularly lower wall 34, tends to go into the dead air space 28 and blow back down therefrom, clearing the space, deflecting winds, dropping out snow, rain and hail particles and aiding the out flow of gases in the flow passages 36 and 37.

In the event of an extremely strong wind gust or blast which might get up channel 37, due to the reversing channel configuration, as has been shown from experience with this ventilator such, blows over the top of the stack 20, increasing the draft, rather than passing down into the stack. This air then exits from the other side of the ventilator out passages 36 and 37.

FIGS. 3 AND 4

In all of the ventilator constructions illustrated, it is assumed that a conventional carpenter's curb (a circular or rectangular framework within the roof opening between the rafters) is provided to hold the roof jack in place. The roof jack fits down and over the curb, with its outboard sheeting overlying the roof sheeting. Suitable sealer and nails are employed to attach the roof jack sheeting to the roof construction surrounding the curb which defines the opening in the roof. These conventional details are not shown as they are well known and standard.

Figure 3:
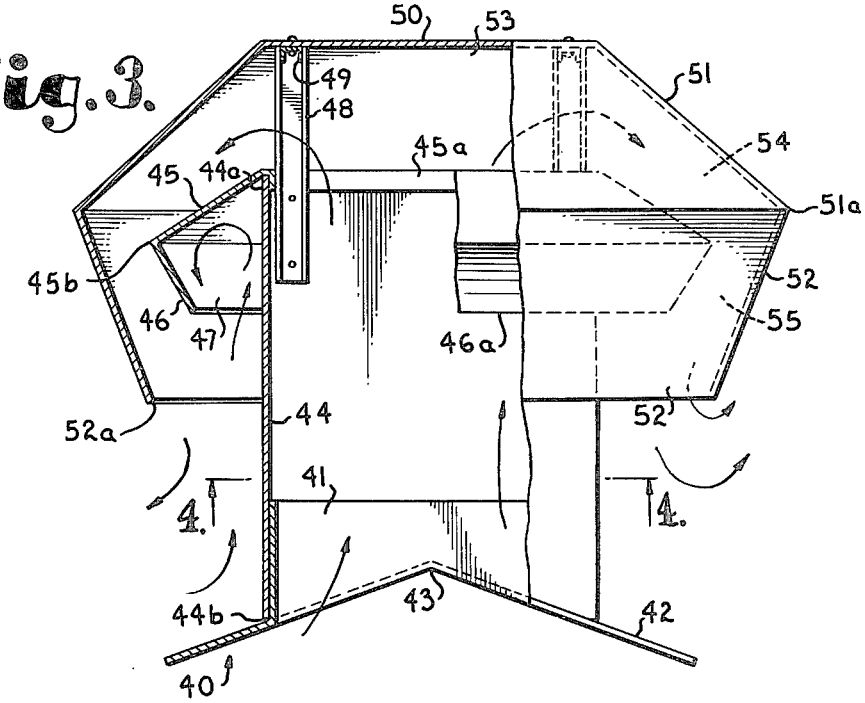
FIG. 3 and FIG. 4 show a second form of the subject improved ventilator.
Figure 4:
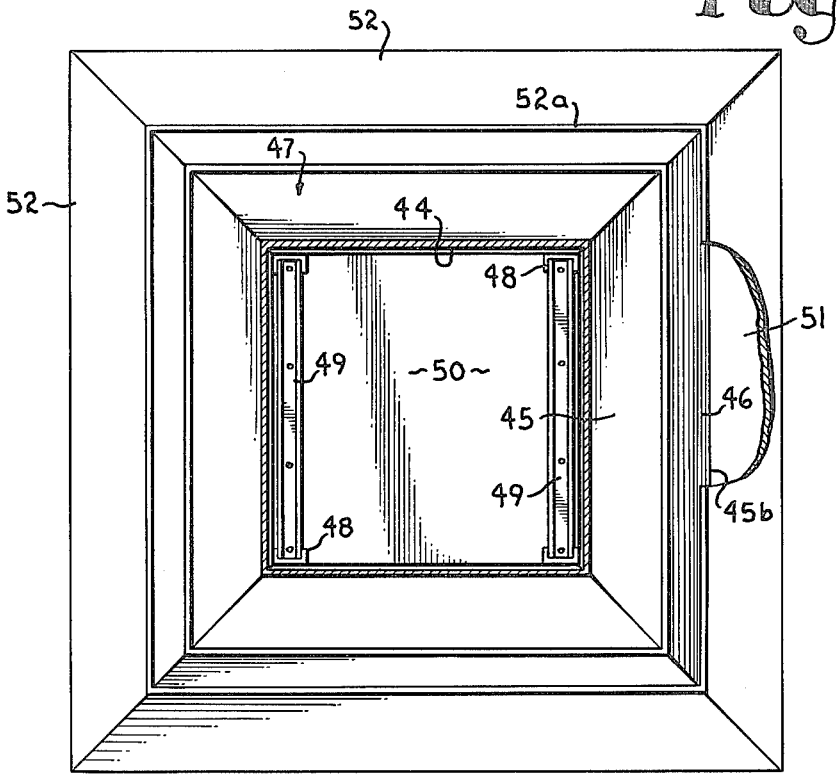

Turning, then, to FIGS. 3 and 4, therein is shown a ventilator construction of square form. A roof jack, generally designated 40 has central sub stack or chimney 41 of square horizontal section with integral peripheral sheeting 42 leading inward to a vertex 43 on two sides of the sub stack 41, centrally thereof. Again, the roof structure, including rafters, sheeting cover, shingles, the opening in the roof, the curb and the like are not shown as these are conventional. The roof jack shown, however, is a ridge or gable type jack mount. The downward angle of sheeting 42 from vertex 43 will be determined by the slope of the roof (as well as the angle of the notch in the sub stack base).

A square stack or chimney 44 having an upper end 44*a* and a lower end 44*b* is slideably mounted over sub stack 41 and fixed thereto by conventional metal fasteners (not shown). In this particular case, where the lower end 44*b* of stack 44 rests on sheeting 42 peripheral to sub stack 41, the lower end must be notched as seen in the view. An inboard hoodlike canopy at the top of stack 44 is made up of first flange 45 which is fixed at its inboard end, via flange 45*a*, to upper end 44*a* of stack 44 and second flange 46 which is continuously fixed at its upper outboard end to the outer periphery 45*b* of first flange 45. Dead air space or trap 47 is provided upwards and inwards of lower edge 46*a* of flange 46.

A second hoodlike canopy is fixed by structural beams and supports 48 (vertical) and 49 (horizontal) over and around the upper end 44*a* of stack 44 and flanges 45 and 46. The second hoodlike canopy is made up of flat, square sheet 50, normally horizontal and substantially the area of the stack 44, to whose peripheral edges are fixed outwardly and downwardly extending frusto-conical sheets 51. Sheets 51 have lower edges 51*a*, to which are connected downwardly and inwardly extending inverted frusto-conical sheets 52 having free edge 52*a*.

In this construction, the outer hoodlike canopy 50, 51 and 52 together with the inner canopy 45 and 46 provide an outlet flow passage made up of relatively large plenumlike zone 53 above stack 44 upper end 44*a*, downwardly and outwardly extending passageway 54 and downward and slightly inwardly extending passageway 55.

In FIGS. 3 and 4, sheets 51 slope downwardly at a greater angle than the angle of flange 45, the lower end 51*a* of sheets 51 is above the lower end 45*b* of flange 45 and the inward angling of sheets 52 is less than the inward angling of flange 46. The flow passage 54 and 55 is in all cases sized to have a larger cross sectional area (overall or summed up) than the cross sectional area of flue or stack 44.

Figure 9:
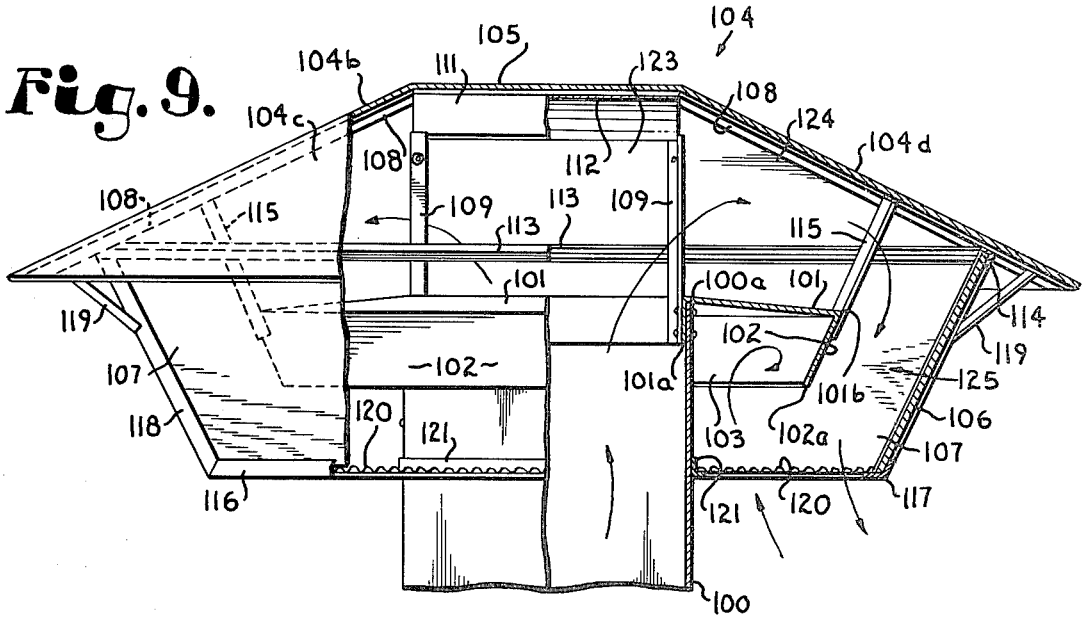
FIG. 9 is a side, partly sectional view of a fifth modification form or version of the subject ventilator with parts cut away to better illustrate the subject construction.
Figure 10:
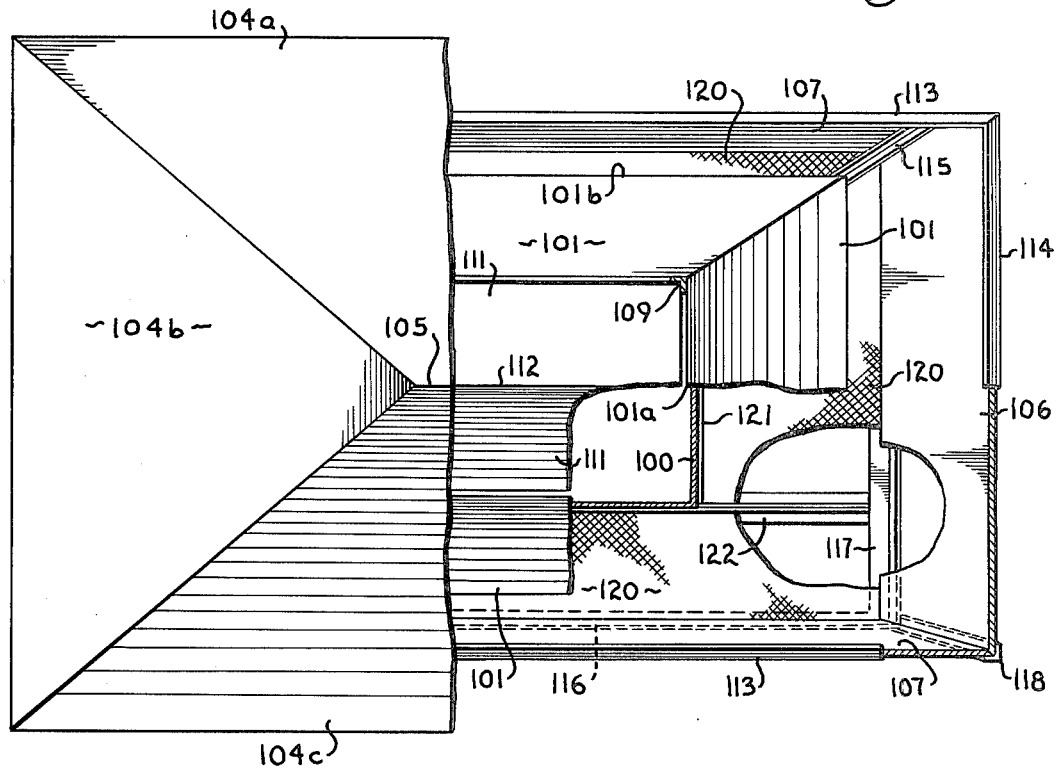
FIG. 10 is a plan view from above of the ventilator construction of FIG. 9 with parts cut away to better illustrate the ventilator construction.

If necessary, additional structurals may be supplied between the flanges defining dead air zone 47 and the outer hoodlike canopy, in the manner seen in FIGS. 9 and 10.

In operation of the device of FIGS. 3 and 4, the impacting of wind and air gusts on the flat sides of the square cross section stack, coupled with the flow of the wind up the roof, tends to cause some problems with back air flow (from the side of the wind direction) into the stack. Accordingly, the skirt 52 is dropped further below the lower edge 46*a* of flange 46 than is seen in the version of FIGS. 1 and 2. Additionally, the opening into dead air zone 47 is opened up more in the version of FIGS. 3 and 4 with flange 46 having a less sharp angle toward the stack than flange 27 in FIG. 1. In both FIGS. 1 and 2 and FIGS. 3 and 4, there is somewhat of a throttling effect going back up passages 55 and 37. This, coupled with the reversing flow passages 54 and 36, tends to lead any excessive air blasts from one side over the top of the stack, increasing draw therefrom, rather than blowing back down into the stack. The construction of FIGS. 3 and 4 is not a hot stack construction and the increased plenumlike zone 53 aids in gathering air pressure to force air and fumes being ventilated out the flow passages 54 and 55. In this construction the relative construction of the flow passages 54 and 55 is opposite flange end 45*b*.

Figure 7:
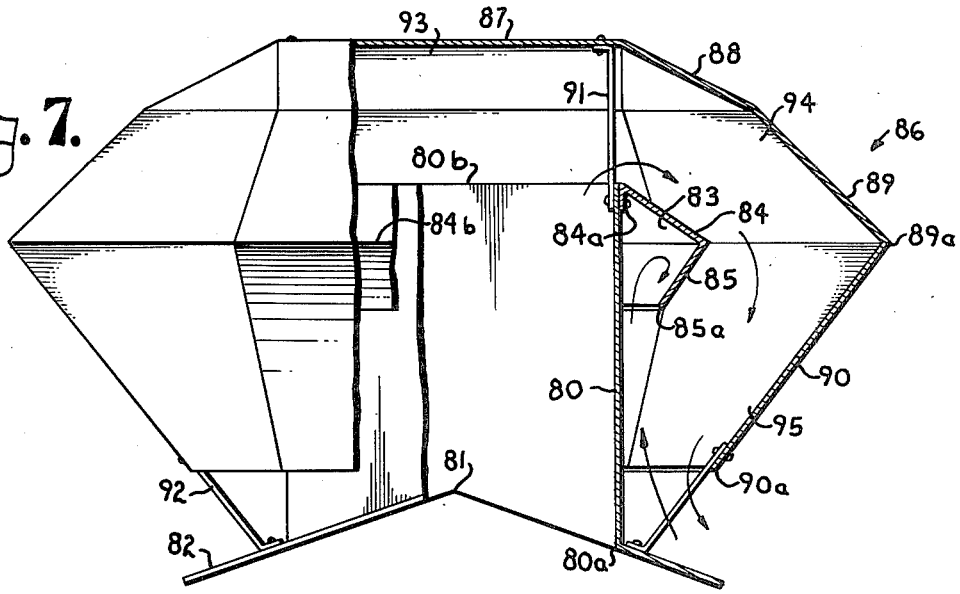
FIG. 7 and FIG. 8 illustrate a fourth variation or modification of the subject improved ventilator.
Figure 8:
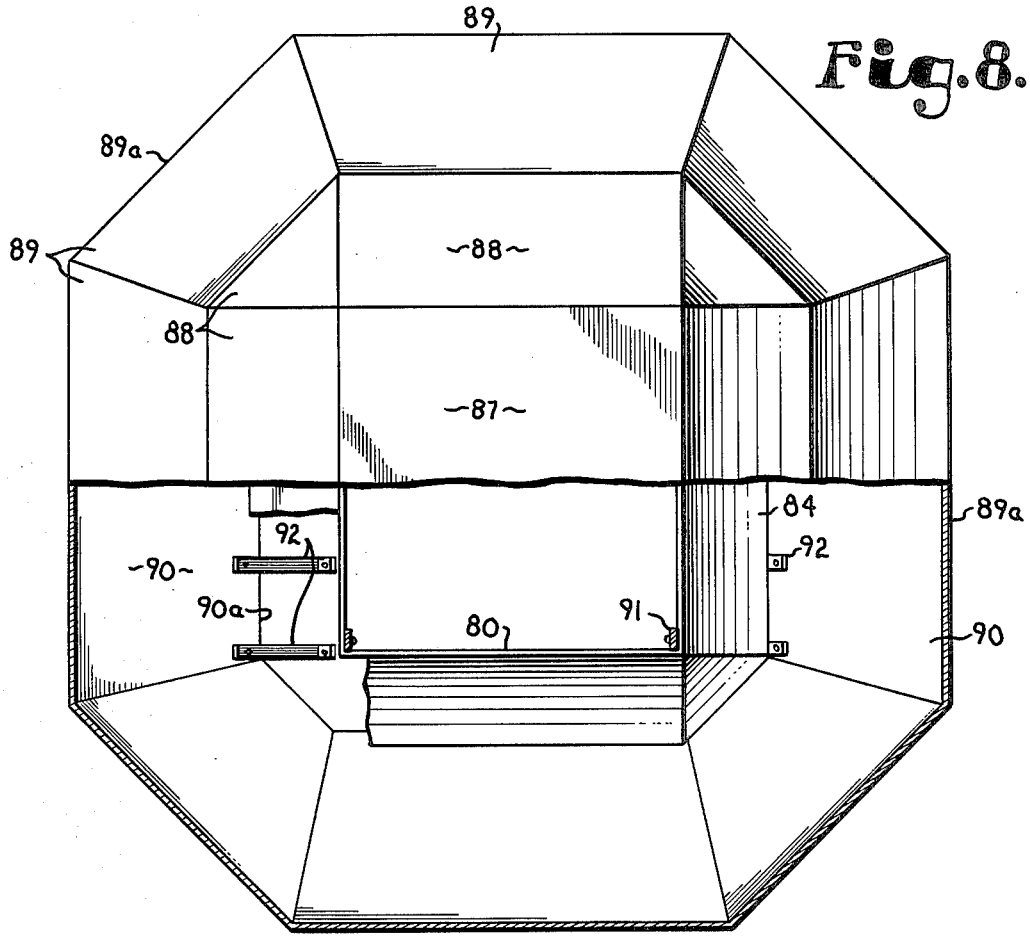

In forms where there is sufficient internal pressure to vent fumes, or a fan is associated with the stack to force the fumes out, the outer hoodlike canopy may closely approach the roof in order to minimize wind or air blasts up under the said outer hoodlike canopy. In such case, as is seen in FIGS. 7 and 8, the dead air zone may be relatively minimum, while the outer hoodlike canopy approaches the roof itself.

However, in most cases, sufficient clearance of the outer hoodlike canopy from the roof is desired that no internal means will be required to force the fumes out the flow passageways or a minimum amount of energy employed in said effort. In such case, the extension of the lower inwardly converging portion of the outer hoodlike canopy below the dead air space zone flanges is governed by the following considerations. If the lower edge of the outer hoodlike canopy is too close to, level with or above the lower edge of the inner hoodlike canopy, then it is quite possible that insufficient air moving up the side of the stack will be captured by the dead air zone for the purposes desired. On the other hand, if the lower edge of the outer hoodlike canopy is too low, even though spaced outward from the stack, it is possible that the upwardly flowing air may channel by the inner hoodlike canopy on the outside thereof. Angling the lower wall of the outer hoodlike canopy inwardly more sharply also will aid in preventing blowback. This option also has a tendency to require more impetus from the stack gases (more back pressure). With the dead air space having an outer inwardly inclining wall return air from this space goes back down the stack wall. With an inwardly inclined flowpath for the stack gases before release, as well as a reversing flowpath thereabove (with or without relative flowpath restrictions), upward gas flow is also minimized. Where the lower end wall of the outer canopy passes below the dead air space outer defining wall lower end, the stack gases can expand into a relatively protected plenumlike zone before final release. All these features of my various forms are of significance in one, several or all variations.

FIGS. 5 AND 6

The ventilator of FIGS. 5 and 6 is a circular section ventilator which is not to be employed as a hot stack or flue. The basic roof jack structure analogous to that of FIGS. 1 and 2 comprises a stub stack or chimney 60 with peripheral sheeting 61 having a vertex 62 attached to the lower end of sub stack 60. A ridge 63 offers a basic snap engagement with the main stack or chimney 64 having lower ridge-groove 65 thereon. Suitable mechanical fasteners are typically also employed (not shown) to provide a secure engagement of the sub stack and stack. The main stack 64 has an upper end 64*a* and a lower end 64*b*.

The inner hoodlike canopy which provides the air, etc., catch zone and antiblowback space 65 is defined by first flange 66 and second flange 67. The former is welded or otherwise attached by inboard flange 66*a* to the outer face of stack 64 at its upper end 64*a*. The outer periphery 66*b* of flange 66 has downwardly and inwardly converging ring flange 67 thereon with a lowermost edge 67*a* defining the input or intake opening of zone 65.

The outboard hoodlike canopy is made up of a conical sheet 68 having a central apex 69 and an outer peripheral edge 68*a*. Continuously attached to the latter is downwardly extending and inwardly converging frusto-conical sheet (inverted) 70 having a lowermost free edge 70*a*. This outermost hoodlike canopy is mounted by structural members 71 to the upper end of stack 64. Additional supporting structurals between flange 66 or flange 67 and sheet 68 may be supplied as will be described with respect to FIGS. 9 and 10 if required for strength and/or rigidity.

In this modification, the conical sheet 68 runs substantially parallel to flange 66, with flange 70 running substantially parallel with flange 67. The plenum zone 72 immediately above the stack leads into flow passage 73 which is considerably enlarged with respect to the cross sectional area of stack 64. That is, the cross sectional area of the entire flow passage 73 is considerably greater than the cross sectional area of stack 64. This gives little flow resistance to ventilation of fumes. The flow passage 74 between flange 67 and lower wall 70 is of greater cross sectional area than flow passage 73, again facilitating outward venting of fumes or gases from within the building ventilated by this construction. The extension of lower edge 70*a* of wall or sheet 70 below flange 67, as well as its inward throw, is such that substantially all air which blows up under the outer hoodlike canopy is captured within the zone 65. The circular horizontal section of the stack and the outer hoodlike canopy minimizes lateral impact of air on the ventilator construction.

FIGS. 7 and 8

This variation shows a square or rectangular stack with an octagonal pair of hoodlike canopies associated therewith. This operates to cut down the total amount of metal employed, compared with a truly rectangular or square ventilator, but makes more complicated the metal forming process. It offers less wind impact area than a true square or rectangular ventilator construction of like size.

In this modification, the roof jack is integral with the main stack. Square or rectangular stack 80 has lower end 80*a* and upper end 80*b*. Lower end 80*a* is notched upwardly on two sides thereof to an apex 81 with conventional jack sheeting 82 formed integral therewith circumferential thereto to fit under conventional roofing cover and over conventional roofing sheeting or the like. The roof structure, adapting curb and the like, being conventional, are not shown.

The inner hoodlike canopy defining the air or blow back capture zone 83 is provided by circumferential first flange 84 and circumferential second flange 85. The former is fixed to the upper outer end (or adjacent thereto) of stack 80 by flange 84*a* and has lower end or edge 84*b* to which the downwardly and inwardly extending second flange 85 with its free lower edge 85*a* is fixed or connected. As may be seen in FIG. 8, particularly with respect to flange 84, flanges 84 and 85 are provided with octagonal faces.

The outer hoodlike canopy, generally designated 86, has a top central square or rectangular panel 87. Immediately peripheral thereto and angling downwardly therefrom are octagonal panel sections 88 having, at their lower ends, octagonal panel sections 89. The lower peripheral edge 89*a* of the latter have the inwardly converging and downwardly extending octagonal panels 90 fixed or continuously circumferentially connected thereto, panels 90 having lower free edges 90*a*. Upper structurals 91 communicate between the underside of central panel 87 and the inside surface of chimney 80. Additional structural support and securement is provided by beams 92 which are connected to the inside lower faces of panels 90 adjacent their lower ends 90*a* and fixed to the jack sheeting 82 at their lower ends.

Plenum zone 93 above the stack leads into flow channel 94 and thence to flow channel 95. The lowermost part of flow channel 95 is provided between the outside surface of stack 80 and the inside surface of panels 90. Once again, the plenum zone and flow paths must always have a cross sectional area greater than the entire cross sectional area of the stack or chimney. This includes at the lower edge 90*a* of panels 90 in this construction.

This device combines maximum protection against blow back air going through the opening defined by edge 90*a* with relatively large flow zones 94 and 95. Typically, a fan or other flow aid will be employed with this form to force the air out under the outer hoodlike canopy. Because the outer canopy extends downwardly so far below the inner hoodlike canopy, the former may be of smaller extent. Additionally, with the lower edge of the outer canopy (90*a*) closely approaching the roof, there is less opportunity for blow back air to get under the ventilator. Inlet (and outlet) restriction are controlled by approach of edge 90*a* to stack 80 or sheet 82 or both.

FIGS. 9 AND 10

Referring to FIGS. 9 and 10, stack 100 has upper end 100*a*. It is square or rectangular in transverse horizontal section as illustrated. The inboard hoodlike canopy is made up of near horizontal flange 101 and downwardly and inwardly converging second flange 102. The former is fixed by inboard vertical circumferential flange 101*a* to the inside surface of stack 100 at the top end 100*a* thereof. Flange 101 has outboard peripheral edge 101*b*, while second flange 102 has lower free edge 102*a*. These flanges produce dead air zone or trap 103.

The outer hoodlike canopy is made up of a roof generally designated 104 having panels or faces 104*a–d*, inclusive with a ridge 105 as the top portion thereof. The lowermost portion of the outer hoodlike canopy is formed of four inverted frusto-conical panels 106 (end) and 107 (side).

Suitable bracing structurals 108 underlie the junctures of panels 104*a–d*, inclusive and converge to beam 108*a*. Vertical angle beams 109 are connected at their lower ends inside the top end 100*a* of stack 100 and also inside of circumferential flange 101*a* on first flange 101. Their upper ends are connected to the undersides of the roof panels 104*a* or 104*c* or structurals 108. Arcuate deflection sheet or panel 111 with apex at 112 may underlie the roof apex at 105.

Normally horizontal angle members 113 (side) and 114 (end) overlie the top edges of panels 107 and 106, respectively, connecting same to the undersides of the roof panels 104*a–d* inclusive. Any gaps under the roof sheeting caused by structurals engaging one another are caulked or filled in conventional manner. Additional angle iron support structurals 115 are secured at their lower ends to the corners of the engagements of first and second flanges 101 and 102, rising to engage at their upper ends the structural members 108. Thus, two sets of peripheral structural elements support the roof, specifically, members 109 connected to stack 100 and members 115 connected to flanges 101 and 102.

Circumferential angle members 116 (side) and 117 (end) frame the bottom ends of panels or sheets 107 and 106, respectively. From these bottom frame members, outermost corner angle members 118 rise to join and engage the upper framing members 113 and 114 which enclose the upper edges of panels 107 and 106. The peripheral roof panels 104*a–104d*, inclusive run downwardly from ridge 105 past the underside engagement with panels 107 and 106 whereby to provide overlap roof portions circumferentially of the said panels 107 and 106 and their uppermost engagements with the underside of the roof. Additional corner structurals 119 may be provided for extra structural support of the periphery of the roof. Yet further, bird and/or insect mesh screening panels 120 may be provided between the lower structural members 116 and 117 and the outer surface of stack 100. Angle members 121 surround stack 100 intermediate its height to anchor the mesh 120 at its inward extension and additional structurals 122 running between stack 100 and lower structural members 117 (lengthwise) may additionally support the mesh screen inserts, if desired.

At the junctures of the various structurals they are welded, brazed or otherwise fixedly attached to one another for rigidity and structural integrity. In a device of the character of FIGS. 9 and 10 of lesser longitudinal length, the flat ridge 105 may be omitted and the structurals 108 continued up to a point ridge, rather than a line ridge. In the design shown, the roof panel edge joiner structurals 108 are brought to two points (the ends of ridge beam 108*a*) at which points same are rigidly joined. Additional central underroof panel structurals (not shown) may run from the center of beam 108*a* down to intermediate horizontal structurals 113 for additional support, if desired (not shown).

By virtue of the presence of stack 100, the outermost hoodlike canopy and the inner hoodlike canopy, the latter made up of flanges 101 and 102 on the stack and the former made up of roof 104 and the downwardly depending panels 106 and 107 therefrom, there are provided the usual flow passage zones. Immediately above the stack upper end 100*a* there is plenumlike zone 123 which leads into the first flow passage 124 above flange 101. The outboard flow passage 125 is between the outer face of flange 102 and panels 106 and 107.

In the structure shown, flow passage 124 converges somewhat outwardly, while flow passage 125 is essentially of uniform transverse section in its length. In all cases, the total transverse section of the flow passages must equal or (preferably) exceed the total transverse area of the horizontal section of the stack. In operation, the fumes or gases from the building rise through stack 100 into the plenum zone 123 and are deflected by the underside of the roof and deflector 111 outwardly into flow passage 124. Thereafter the gases change angle and go downwardly and inwardly through flow passage 125 and out through the bird screen under the bottom edges of panels 106 and 107. Any air which blows against the ventilator construction laterally or moves up the roof to it is taken into the dead air zone 103 to minimize blow back up into the cupola or housing overlying and surrounding the stack. In this ventilator, as in the others previously described, the outward and downward passage of the gases from the flue or stack also tend to deflect any in and upwardly coming gases centrally to be caught in the dead air zones. Truly lateral or horizontal air gusts or motion is deflected from the top of the stack by the depending panels 106 and 107, while the flanges 101 and 102 provide a dead zone to catch upwardly moving gusts and air blasts, also trapping snow, hail, rain particles and the like. A conventional roof jack connection like that seen in FIGS. 3 and 4 is used to make the engagement with the roof gable for the construction shown.

GENERAL REMARKS

Thus there has been provided a new ventilator construction designed for general gable use and applications including housing, commercial, industrial, livestock, grain and hay buildings, along with other special applications. The geometry, as illustrated, may be circular, square, rectangular or octagonal. These devices give waterproof ventilation adequately, in most cases without the requirement of fans or blowers being associated therewith. The attic or building pressure operates to override the outside air flow or pressure thus to flow the interior atmosphere to escape, along with heat, sweat, fumes and the like. Outside air, wind, rain, snow or other elemental factors are trapped in a circumferential air space at the top of the stack, causing a fall back effect. If the trap was not provided, in most cases, the ventilator, although overlaid and surrounded by a hoodlike canopy, would be subject to back pressure, blow back and invasion by gusts of wind, etc. from the outside. In addition to trapping impinging air blasts (which may be directed by the configuration of the roof, as well as the presence of the stack itself), the walls of the trap additionally serve, with the outer most hoodlike canopy, to channel the escaping gas flow from the stack from a central plenum zone outwardly and downwardly and then inwardly and downwardly in a manner which also tends to minimize blow back effects. Specifically, that is, not only does air running up the stack outer surface run directly into the trap or dead air zone, any such invading air (and particles or elements contained therein) which escape the trap must go upwardly and outwardly before such can thereafter approach the stack and this must be done through an outwardly and downwardly inclined flow passage above the dead air space. In the event of the most abnormal conditions which might bring air from the outside to the top of the stack, the configuration of the air passages and the walls defining the dead air space, together with the presence of the plenum zone over the stack tends to have such invading air merely flow over the top of the stack to the other side, thus actually increasing the draw in the stack, rather than blowing back down it.

In all cases the cross sectional area of the outward flow passages is equal to or greater than the cross sectional area of the stack. Restrictions (relative) within this principle may also aid in controlling blow back, with restrictions possible in the upper and outward or downward and inward flow passage portions. Additional structural support may be provided for the outside hoodlike canopy from the roof itself and/or the flanges on the stack which define the dead air zone. The ultimate air discharge zone below the dead air space may be readily screened with bird and/or screening. While the roof jacks shown are adapted to roofs with relatively mild slope, steeper pitched roofs simply require deeper pitched roof jack sheeting angles and sub stack notching.

The bird screen or insect mesh which may be emplaced in any of the ventilators shown between the lower edge of the outer canopy lower wall and the stack may be upwardly inwardly angled (not necessarily horizontally mounted). The plenum or plenumlike chambers over the stacks under the top canopy serve as pressure gathering or building zones before discharge into the peripheral ducts between the canopies. Excess wind pressure on one side of the ventilator tends to create a lessened or vacuum pressure on the other side, thus aiding drawover of any air that works back up the vent passages against the discharge stream.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A ventilator construction comprising, in combination, a normally vertical, hollow centered stack for flowing air or gas therethrough, said stack made up of a continuous, enclosing wall having upper and lower ends both open, the lower end of the stack adapted to be put into communication with an opening in the roof of a housing structure to receive air or gas flow therefrom, the upper end of the stack adapted to discharge the said air or gas upwardly therefrom, a first hoodlike canopy overlying and partially enclosing the upper end of said stack, said first hoodlike canopy made up of a first uppermost portion centrally overlying the stack and, at least peripherally of the stack upper end, angling outwardly and downwardly, the outermost portion of the first hoodlike canopy extending downwardly and inwardly past the upper edge of said stack, a second, inboard hoodlike canopy surrounding the stack adjacent the upper end of the stack and circumferentially connected thereto, said inboard second hoodlike canopy having an upper portion extending circumferentially outwardly and slightly downwardly from its connection to the stack peripherally and circumferentially thereof, with a lower portion of said second hoodlike canopy extending downwardly and inwardly toward the periphery of the stack from the periphery of the first portion thereof, the inboard hoodlike canopy defining a dead air capture space closely adjacent the top of the stack but immediately peripheral thereto, the two hoodlike canopies defining between them and the stack a central plenumlike zone, a first circumferential air passage extending outwardly and downwardly from the plenumlike zone and a further air passage extending downwardly and inwardly to discharge below the lowermost portions of the two canopies, the lowermost portion of the outboard first canopy extending substantially below the inboard second canopy lowermost portion circumferentially thereof, and means connecting each of the said hoodlike canopies to the upper end portion of said stack.

2. A ventilator as in claim 1 wherein the cross sectional area of the flow passages defined by the two hoodlike canopies is always at least as great as the cross sectional discharge area of the stack throat at its outlet.

3. A ventilator as in claim 1 wherein the stack is circular in horizontal transverse section, the first hoodlike canopy is circular in plan view and the upper portion of the second inboard hoodlike canopy is a circular, hollow centered ring.

4. A ventilator as in claim 1 wherein the first hoodlike canopy is supported by a first set of beam members connected at their upper ends with the inside canopy surface and at their lower ends to the upper end of the stack and a second set of beam members connected at their upper ends with the inside first canopy surface and at their lower ends with the second canopy.

5. A ventilator as in claim 1 wherein the stack is rectangular in horizontal transverse section, the first hoodlike canopy is rectangular in plan view and the upper portion of the second inboard hoodlike canopy is a rectangular, hollow centered ring.

6. A ventilator as in claim 1 wherein the stack is rectangular in horizontal transverse section, the first hoodlike canopy is octagonal in plan view and the upper portion of the second inboard hoodlike canopy is an octagonal, hollow centered ring.

7. A ventilator as in claim 1 wherein a mesh screen communicates between the base of the first hoodlike canopy and the side wall of the stack in substantial horizontal extension peripheral to the stack and inboard of the outermost portion of the first hoodlike canopy.

8. A ventilator as in claim 1 wherein there is a relatively greater volume of space centrally under the first hoodlike canopy than peripherally between the first hoodlike canopy and upper portion of the second inboard hoodlike canopy, thereby to form a plenum-like zone above the stack discharge, the cross sectional area of the flow passageways defined by the two hoodlike canopies always at least as great as the cross sectional discharge area of the stack throat at its outlet.

9. A ventilator as in claim 1 wherein the cross sectional area of the flow passages defined by the two hoodlike canopies is always as great as the cross sectional discharge area of the stack throat at its outlet, there being, however, a relative restriction in the air flow passage between the outermost portion of the first hoodlike canopy and a lower portion of said second hoodlike canopy.

10. A ventilator as in claim 9 wherein the lowermost portion of the second inboard hoodlike canopy comprises a substantially vertically oriented circumferential flange.

11. A ventilator as in claim 1 wherein the outermost portion of the first hoodlike canopy and the lower portion of the second hoodlike canopy extend substantially parallel with one another.

12. A ventilator as in claim 1 wherein the outermost portion of the first hoodlike canopy angles inwardly toward the stack at a sharper angle than the lower portion of the second hoodlike canopy.

13. A ventilator as in claim 1 wherein the lower portion of the second hoodlike canopy angles inwardly toward the stack at a greater angle than the outermost portion of the first hoodlike canopy.

14. A ventilator as in claim 1 wherein at least the portion of the first hoodlike canopy overlying the upper end of the stack is horizontal.

15. A ventilator as in claim 1 wherein at least the outer part of the first hoodlike canopy which extends outwardly and downwardly extends below the top edge of said stack.

* * * * *